US005559827A

United States Patent [19]

Shimada et al.

[11] Patent Number: 5,559,827

[45] Date of Patent: Sep. 24, 1996

[54] VACUUM MELTING-PRESSURE POURING INDUCTION FURNACE

[75] Inventors: Takashi Shimada; Kenji Kitanaka; Akio Kaneshiro; Michio Kawasaki, all of Kanagawa-ken, Japan

[73] Assignees: Nippon Mining & Metals Co., Ltd., Tokyo; Fuji Electric Co., Ltd., Kanagawa-ken, both of Japan

[21] Appl. No.: 418,326

[22] Filed: Apr. 7, 1995

[30] Foreign Application Priority Data

Apr. 28, 1994 [JP] Japan ..... 6-113879

[51] Int. Cl.[6] ..... F27D 3/00

[52] U.S. Cl. ..... 373/142; 373/143; 266/242; 432/121

[58] Field of Search ..... 373/142, 143, 373/151, 159, 146; 432/121; 266/242

[56] References Cited

U.S. PATENT DOCUMENTS

| | | | |
|---|---|---|---|
| 1,269,236 | 6/1918 | Weaver | 373/143 |
| 2,536,859 | 1/1951 | Tama | 373/143 |
| 2,597,269 | 5/1952 | Tama et al. | 373/143 |
| 2,937,789 | 5/1960 | Tama | 373/143 |
| 3,472,942 | 10/1969 | Campbell | 373/143 |
| 3,991,263 | 11/1976 | Folgero et al. | 266/217 |
| 5,222,096 | 6/1993 | Reuter | 373/143 |
| 5,304,230 | 4/1994 | Steins et al. | 373/140 |

FOREIGN PATENT DOCUMENTS

| | | |
|---|---|---|
| 0392067A1 | 10/1990 | European Pat. Off. . |
| 1255657 | 1/1961 | France . |
| 2701412A1 | 8/1994 | France . |
| 2901763A1 | 7/1979 | Germany . |
| 4114683A1 | 11/1992 | Germany . |
| 2266945 | 11/1993 | United Kingdom . |

*Primary Examiner*—Tu Hoang
*Attorney, Agent, or Firm*—Panitch Schwarze Jacobs & Nadel, P.C.

[57] ABSTRACT

A furnace in the invention includes an induction melting furnace housed in an air-tight container which can be pressurized to the desired level of maximum allowable pressure and can be vacuum evacuated to a desired level of pressure; a vacuum melting furnace cover having a vacuum evacuating pipe; and a pressure pouring furnace cover, which has a pressure piping to impress the pouring pressure controlled by a pouring pressure control device onto the inside of the furnace and has a pouring siphon, which has its lower end opened to the bottom part within the induction melting furnace and has its upper end connected to a pouring chamber having a pouring nozzle, penetrated therethrough. In the furnace with the construction, the molten metal having been vacuum melted in the induction melting furnace within the air-tight container, which has been tightly closed with the vacuum melting furnace cover and has been vacuum evacuated with the vacuum evacuating pipe, can be poured from the pouring nozzle using the pouring siphon by replacing the vacuum melting furnace cover with the pressure pouring furnace cover and impressing the pressure from the pressure piping to the inside of the air-tight container, which has been tightly closed by the pressure pouring furnace cover, to the maximum allowable pressure.

20 Claims, 5 Drawing Sheets

VACUUM MELTING-PRESSURE POURING INDUCTION FURNACE

BACKGROUND OF THE INVENTION

The present invention relates to an induction furnace serving both for vacuum melting and pressure pouring, in which a furnace cover is replaced and molten metal obtained by vacuum melting in the induction melting furnace can be continuously poured by a pressure pouring.

In the melting of alloys containing metal which is active (hereinafter called active metal), it is indispensable to prevent the oxidation of active metal within the alloys for enhancing the yield of active metal and the ingot quality.

Therefore, a so-called vacuum melting process which has been hitherto used is a method to melt the alloy in an induction melting furnace within an air-tight container which has been vacuum evacuated (hereinafter called a melting furnace), and this method constitutes an effective means for preventing the oxidation of the alloy.

On the other hand, a vacuum casting process to cast the molten metal into a mold which is housed within the same air-tight container is effective as a means to cast the molten metal under a state in which the cleanliness of the vacuum molten metal is preserved, however, the casting within an air-tight container with a limited inside volume will be limited to a so-called ingot making, where such works as casting, scalping, etc. will be needed before the ingot is hot rolled.

In the prior art as mentioned above, as a melting furnace was housed within an air-tight container, there was no effective means for removing slag which has been generated during the vacuum melting, thus it was necessary to limit the raw material to be molten. It was necessary to melt only virgin raw material ordinarily, avoiding the use of scrap for holding the amount of slag generated down to the minimum level. However, as the melting furnace was tilted for taking the molten metal out when the molten metal was cast into a mold, the slag which had been unavoidably generated will be poured into the pouring sprue along with the tilting of the melting furnace and was unavoidably entrained into the mold.

On the other hand, when a large size ingot was needed, it was necessary to provide a large size air-tight container which housed a melting furnace and a mold in a vacuum melting - vacuum casting process, further the vacuum evacuating capacity had to be increased. Therefore, while a casting with a continuous casting method was desirable for manufacturing a large size ingot which could be directly hot rolled from a standpoint of cost competitiveness, a tremendous amount of equipment investment was needed to have an entire continuous casting equipment housed with an air-tight container.

Thus, when a continuous casting was done, the molten metal which had been vacuum melted had to be first poured to a transfer path to a continuous casting equipment such as a spout under the atmosphere or protective ambient atmosphere, where an oxidation at the pouring sprue or in the transfer path was unavoidable together with flow-in of the slag with the tilting of the furnace, which lowered the ingot quality.

SUMMARY OF THE INVENTION

The present invention is made in view of the above, and has an object of providing an induction furnace serving both for vacuum melting and pressure pouring, which can restrain the generation of slag even when scrap is melted as raw material at the time of melting and casting the alloy containing active metal and can take out the molten metal to outside of the furnace without entraining the generated slag, thus capable of continuously casting a large size ingot.

The present invention lies in an induction furnace serving both for vacuum melting and pressure pouring for achieving the above mentioned object, and relates to an induction furnace serving combinedly for vacuum melting and pressure pouring, comprising an induction melting furnace housed within an air-tight container which can be pressurized to the maximum allowable pressure desired and at the same time can vacuum evacuate itself to the desired pressure, a vacuum melting furnace cover having a vacuum evacuating pipe, and a pressure pouring furnace cover which has a pressure piping to impress the pouring pressure being controlled by a pouring pressure control device onto the inside of the furnace and has a pouring siphon, which has its lower end opened to the bottom part of the above mentioned induction melting furnace and has its upper end connected to a pouring chamber with a pouring nozzle, penetrating therethrough. In the present induction furnace, a vacuum melting of metal is made in the induction melting furnace within an air-tight container, which has been tightly closed with the above mentioned vacuum melting furnace cover and has been vacuum evacuated with the vacuum evacuating pipe, and the above mentioned vacuum melting furnace cover is replaced with the above mentioned pressure pouring furnace cover, and then the pressure is impressed through the pressure piping into the inside of the air-tight container which has been tightly closed with the pressure pouring furnace cover to the level of the maximum allowable pressure, and thus the molten metal can be poured out of the pouring nozzle using the above mentioned pouring siphon.

Here, the above mentioned induction furnace serving both for vacuum melting and pressure pouring may be an induction melting furnace of a core-less crucible type or a channel type induction melting furnace. And this induction furnace serving combinedly for vacuum melting and pressure pouring has a raw material charging device and a molten metal temperature detecting device of an air-tight type capable of vacuum evacuation provided at the vacuum melting furnace cover. Also, an external heating device or an induction type heating device is provided at the pouring chamber. Further, the vacuum melting furnace cover and the pressure pouring furnace cover are made shiftable in the up and down direction and in the horizontal direction by cylinders or electric driving devices.

DETAILED DESCRIPTION OF THE PREFERRED EMBODIMENT

Figure 1:
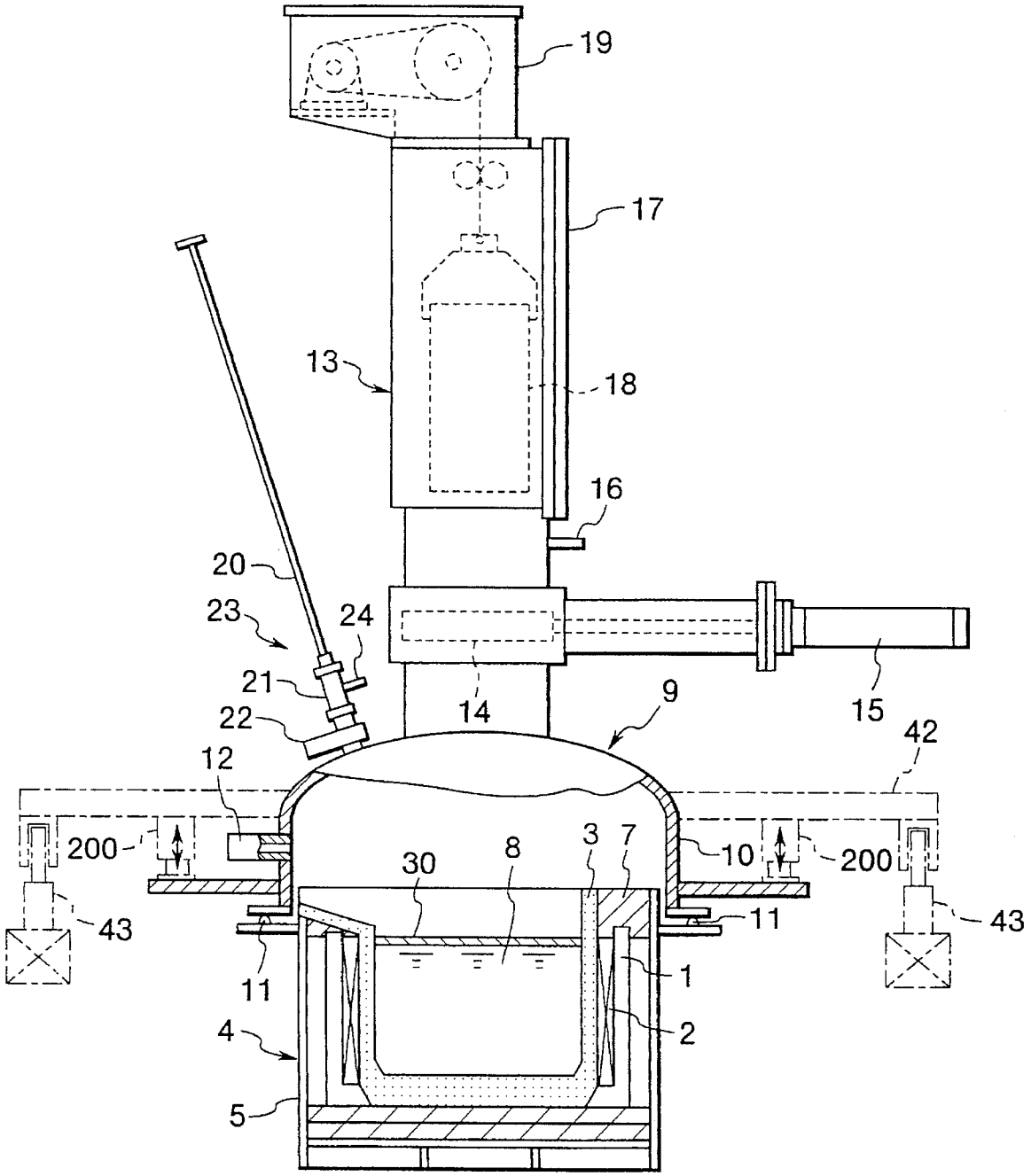
FIG. 1 is a cross-sectional schematic drawing of a furnace when the vacuum melting furnace cover is mounted.

One embodiment of an induction furnace serving both for vacuum melting and pressure pouring according to the present invention shall be explained by referring to the drawings attached. While a core-less crucible type induction melting furnace is used as the induction furnace in this embodiment, the present invention is not limited to the same.

FIG. 1 is a cross-sectional schematic drawing of an embodiment in which a vacuum melting furnace cover 9 is mounted at an upper end of an air-tight container 5 housing an induction melting furnace of a core-less crucible type, as will be described below in details.

In FIG. 1, the induction melting furnace 4 of a core-less type consists of a crucible 3 made of refractory material, induction heating coils 2 placed at the outer circumference of the crucible 3, and a yoke 1. The air-tight container 5 and the vacuum melting furnace cover 9 are tightly closed by packing 11, and the inside of the air-tight container 5 is vacuum evacuated from a vacuum evacuating pipe 12 by a vacuum pump not shown in the drawing. A raw material charging device 13 is provided on top of the vacuum melting furnace cover 9.

The above mentioned raw material charging device 13 and the vacuum melting furnace cover 9 are separated with a gate valve 14 which is opened and closed with a cylinder 15, where the gate valve 14 is opened after the inside of the raw material charging device is vacuum evacuated with a vacuum pipe 16 by a vacuum pump not shown in the drawing thus bringing the pressure down to the same level as that of the inside of the air-tight container 5, so that a raw material charging bucket 18 containing additional raw material such as scrap is lowered down to a position immediately above the melting furnace for making an additional charging into the melting furnace. Here, the reference number 17 shows a door of the raw material charging chamber. A molten metal temperature detecting device 23 can have its thermocouple 20 inserted into the melting furnace thus the temperature of molten metal under vacuum can be measured by opening a gate valve 22 after the inside of an auxiliary chamber 21 is vacuum evacuated with a vacuum evacuation pipe 24 by a vacuum pump not shown in the drawing and its pressure is reduced down to the same level as that of the inside of the air-tight container 5.

Figure 2:
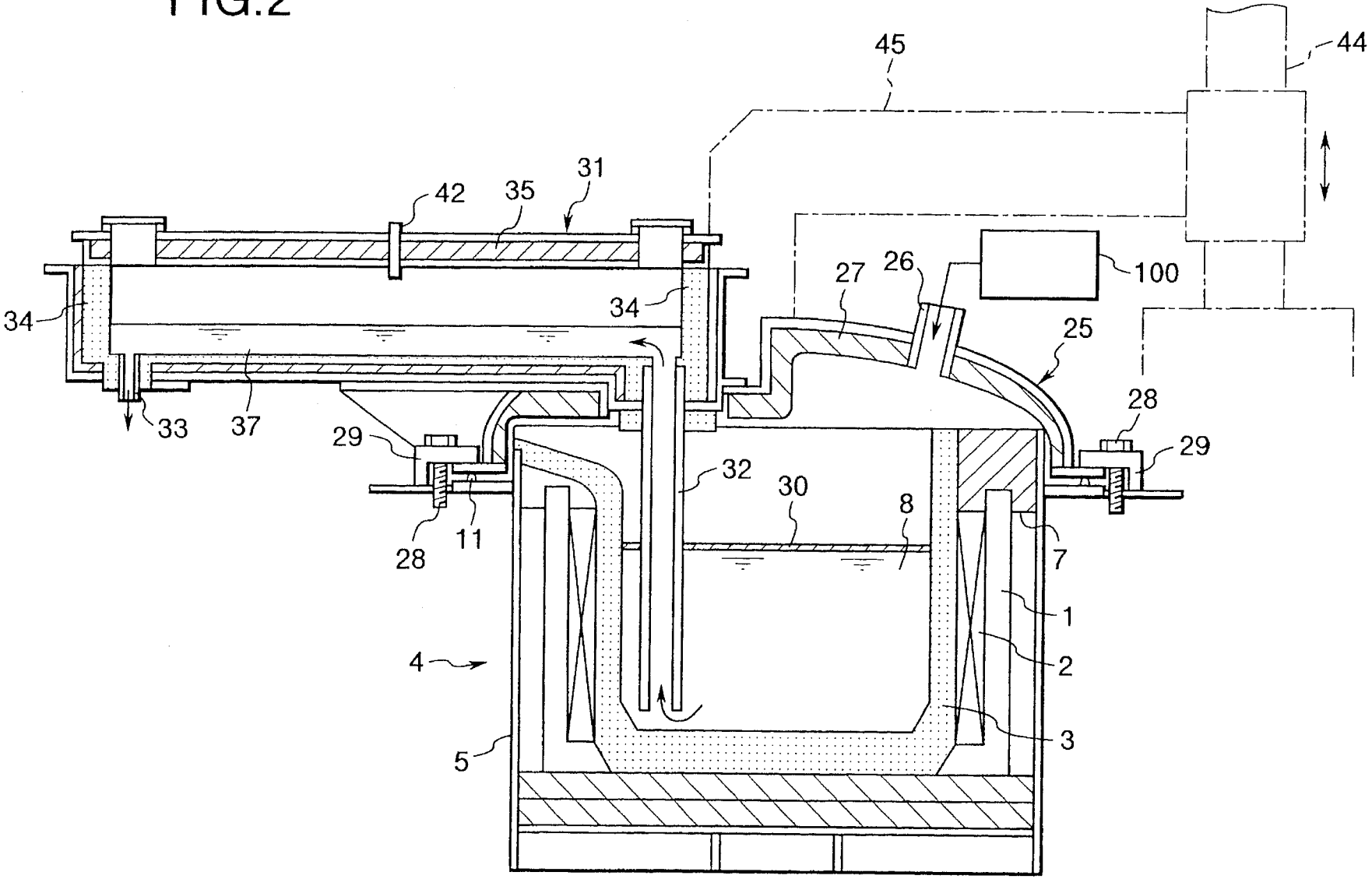
FIG. 2 is a cross-sectional schematic drawing of a furnace when the pressure pouring furnace cover is mounted.

FIG. 2 is a cross-sectional schematic drawing of an embodiment in which a pressure pouring furnace cover 25 is provided on an upper end of the air-tight container 5 which houses the same induction melting furnace 4 of a core-less crucible type, as will be described below in details.

This pressure melting furnace cover 25 is fixed to the air-tight container 5 with a bolt 28 and a retaining metal fitting 29, and the air-tight container 5 and the pressure pouring furnace cover 25 are tightly closed with the packing 11. When inert gas pressure, which is controlled by a pouring pressure control device 100, is impressed to the inside of the air-tight container 5 from a pressure pipe 26 provided at the pressure pouring furnace cover 25, the surface of molten metal 8 within the crucible 3 of the melting furnace 4 is pushed down, then the molten metal 8 ascends in a pouring siphon 32 which is inserted to the bottom part of the melting furnace and is pumped up to a pouring chamber 31.

At this time the maximum pressure impressed in this embodiment is held to a level of below 1 normal atmospheric pressure from the standpoint of safety in the work and the efficiency of operations of the equipment. The maximum height pumped up will be determined with this maximum pressure and the specific gravity of the molten metal (alloy), and a diameter and a depth of the melting furnace will be designed from a required amount of molten metal to be poured and said maximum height. While the maximum allowable pressure is held to a level of below 1 normal atmospheric pressure in this embodiment, this is merely one example of the present invention, and is not to limit the scope of what is claimed in the invention.

Figure 3:
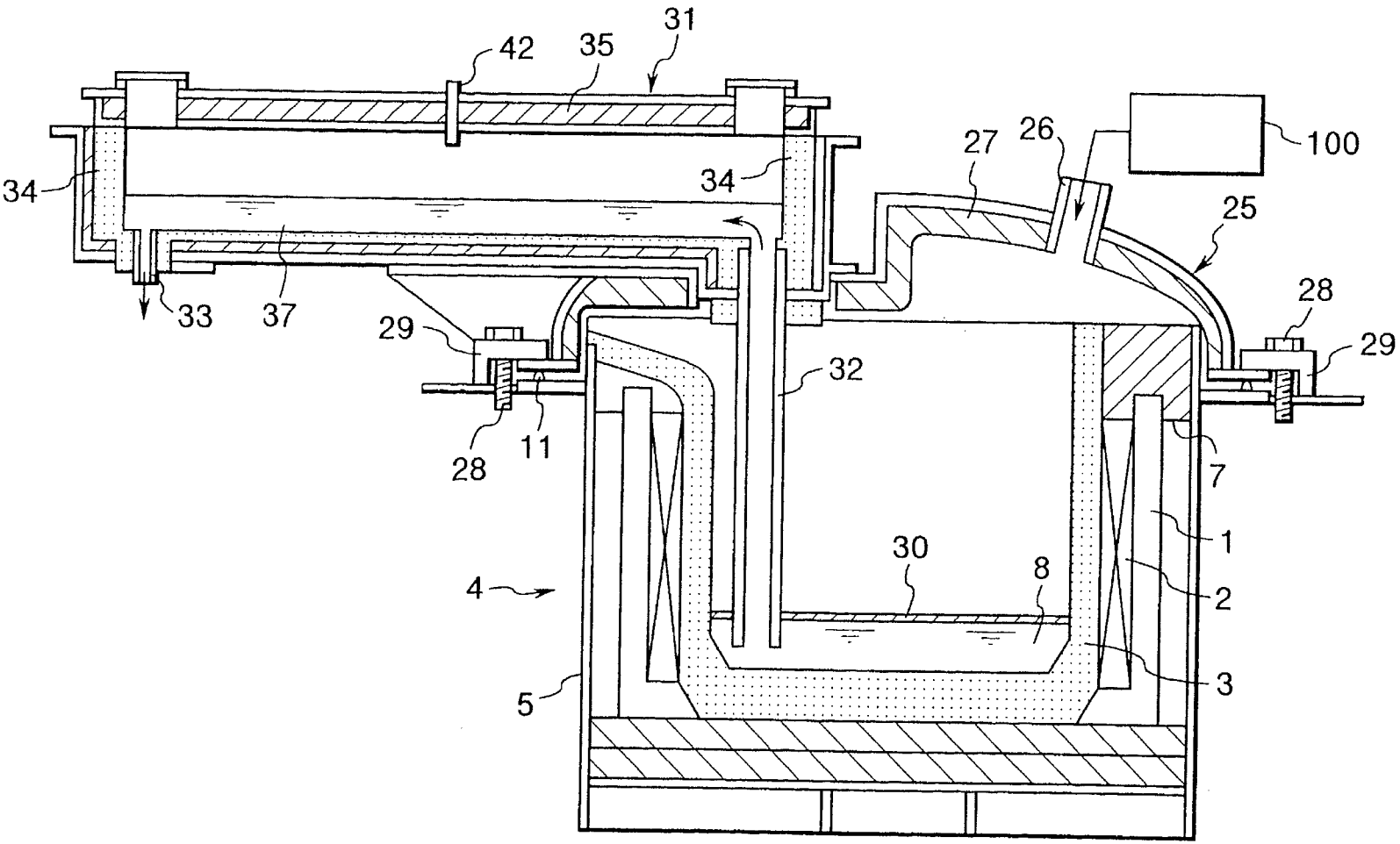
FIG. 3 is a cross-sectional schematic drawing for a furnace when a pouring of a prescribed amount of molten metal has been completed.

The molten metal 37 pumped up to the pouring chamber 31 under the pressure through the siphon 32 is poured through a pouring nozzle 33 provided at the other end of the pouring chamber 31 to a continuous casting equipment not shown in the drawing, where a control of the pouring amount is done by the control of the pressure impressed to the inside of the air-tight container 5 by the pouring pressure control device 100, thus a prescribed amount can be continuously poured. Then, as an amount of molten metal poured reaches a predetermined amount, the impressing of the pressure to the inside of the air-tight container 5 by the pouring pressure control device 100 is stopped. Since the pouring siphon 32 is inserted close to the bottom of the melting furnace 4, only clean molten metal separated from the floating slag 30 ascends within the pouring siphon 32. And the floating slag 30 remains floated on the surface of the molten metal within the furnace until the pouring of a predetermined amount of molten metal is finished as shown in FIG. 3, thus it will not be entrained in the molten metal being poured to the continuous casting equipment.

Figure 4:
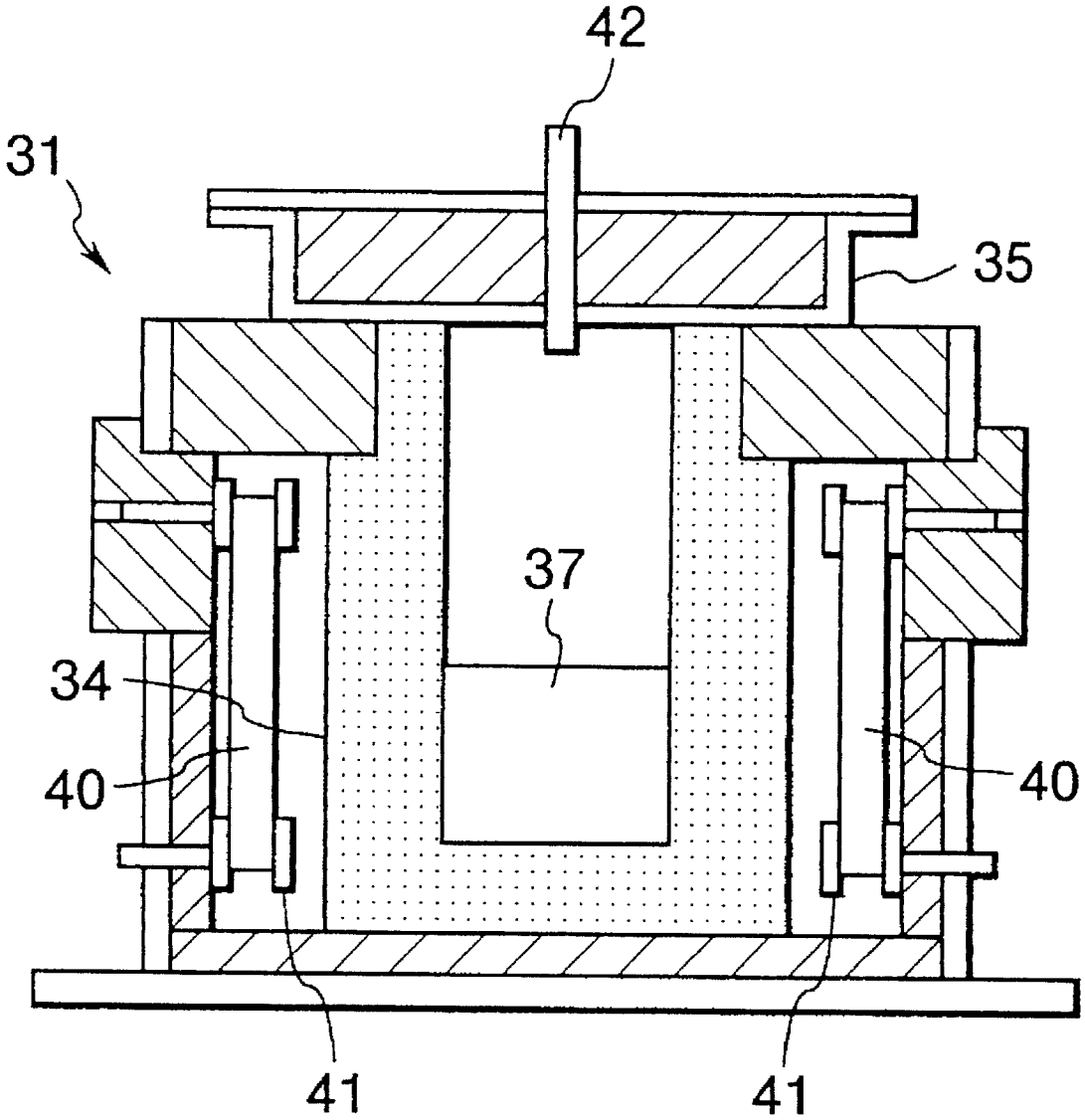
FIG. 4 is a cross-sectional schematic drawing of a pouring chamber.

FIG. 4 is a detailed cross-sectional view of the pouring chamber 31 provided above the pressure poring furnace cover 25 in this embodiment, where electric heaters 40 are supported by heater supporters 41 at the side wall of the pouring chamber 31. As the pressure pouring is started after a pouring spout 34 within the pouring chamber 31 has been heated beforehand to a prescribed temperature by this electric heater 40, the drop in the temperature of the pumped up molten metal 37 can be prevented. As the electric heater 40 is controlled by a thermocouple and a power control device not shown in the drawing, the temperature within the pouring chamber 31 is maintained at a constant level. Here, the upper portion of the pouring chamber 31 is tightly closed with a pouring chamber closing cover 35 which can be opened and closed, and inert gas is sealed in from a gas pipe 42 for preventing the molten metal 37 from being oxidized.

While the above embodiment shown from FIG. 1 to FIG. 4 employs an induction melting furnace of a crucible type as the melting furnace 4 and the electric heater as the heating device 40 of the pouring chamber 31, similar effects can be obtained also when a channel type induction furnace is used as the melting furnace 4 and an induction heating device is used as the heating device 40.

Figure 5:
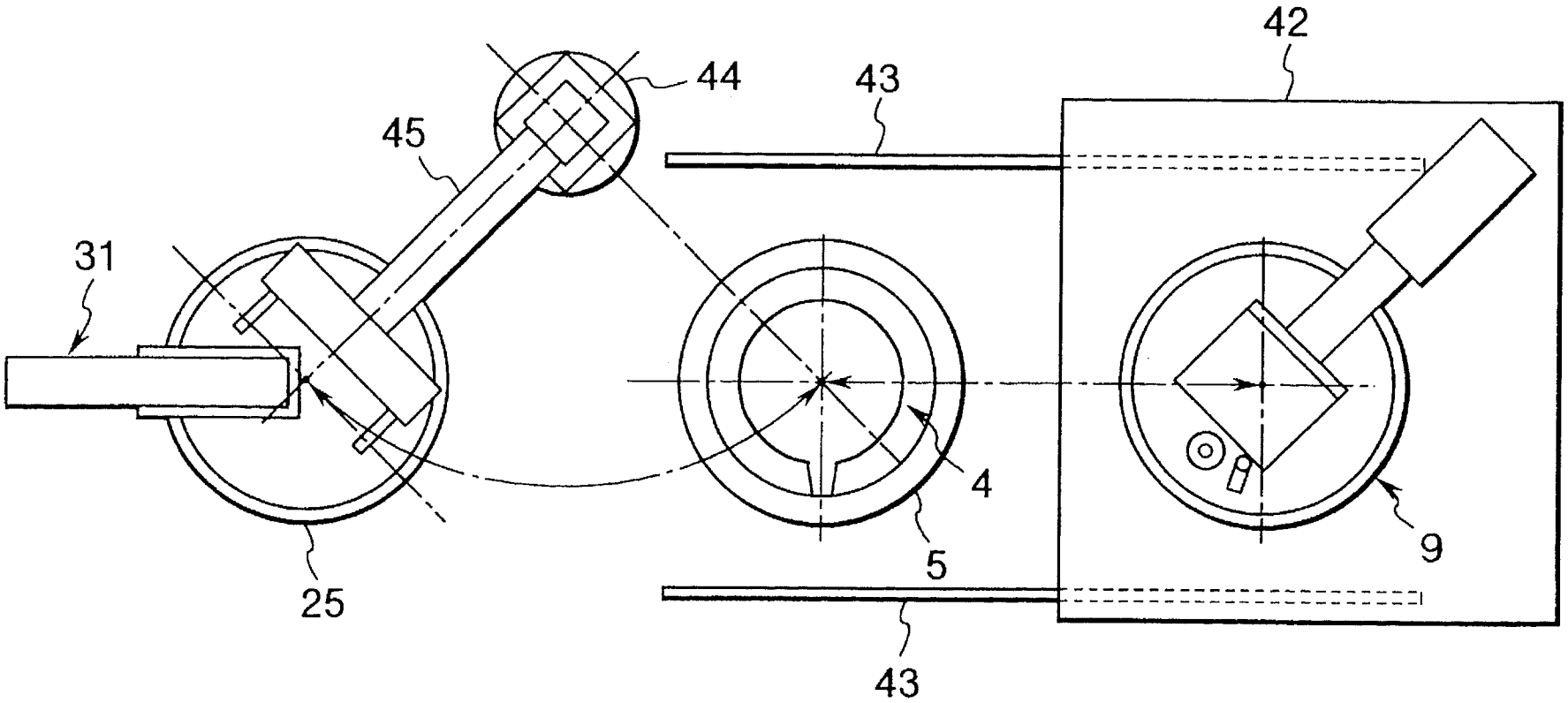
FIG. 5 is a schematic drawing for the shifting arrangement for an induction melting furnace, a vacuum melting furnace cover and a pressure pouring furnace cover.

FIG. 5 is a schematic drawing showing a positional shifting arrangement for the air-tight container 5 housing the melting furnace 4, the vacuum melting furnace cover 9, and the pressure pouring furnace cover 25.

As will be understood by referring also to FIG. 1, the vacuum melting furnace cover 9 is suspended on a vacuum melting furnace cover travelling bogie 42 with hydraulic cylinders 200 and it ascends and descends by activating the hydraulic cylinders 200. When the vacuum melting furnace cover 9 is at its ascended end, the vacuum melting furnace cover travelling bogie 42 travels on travelling rails 43 with an electric driving device not shown in the drawing. This vacuum melting furnace cover travelling bogie 42 travels from a stand-by position shown in FIG. 5 to a position above the furnace 4 when a vacuum melting is done, and the furnace cover 9 is lowered by activating the hydraulic cylinders 200 to tightly close the upper end of the air-tight container 5. Also, when the furnace cover 9 is replaced, it ascends with the hydraulic cylinders 200 to release the air-tight container 5 and travels to the stand-by position.

On the other hand, as will be understood by referring also to FIG. 2, the pressure pouring furnace cover 25 suspended by a suspending arm 45 ascends and descends by an elevating and revolving device 44 and is revolved at its ascended end. And when a pressure pouring is done, it is revolved by 90° from the stand-by position shown in FIG. 5 to a position above the furnace 4 and descends, then is fixed to the furnace 4 with a bolt 28 and a retaining metal fitting 29 to tightly close the air-tight container 5. When the pressure pouring is completed, it ascends after being unfixed for releasing the air-tight container 5, then it is revolved to the stand-by position. The elevating device 44 for the pressure pouring furnace cover 25 needs to have a large ascending and descending stroke as the pouring siphon 32 protrudes below the furnace cover 25. With the elevating, travelling and revolving devices in this embodiment, the length of time required for replacing the vacuum melting furnace cover 9 and the pressure pouring furnace cover 25 is about 2 minutes, thus a reliable replacement of the furnace covers can be done within a short period of time.

Next, explanation shall be made on the function of the induction furnace serving both for vacuum melting and pressure pouring according to the present invention which is arranged as mentioned above.

First, the vacuum melting furnace cover 9 at the stand-by position is shifted by a shifting means to the upper end part of the air-tight container 5, and the vacuum melting furnace cover 9 is mounted on and tightly closed at the upper end of the air-tight container 5 which houses the induction melting furnace 4 as shown in FIG. 1, thus forming a so-called vacuum melting furnace. Then, the inside of the air-tight container 5 is evacuated to a desired pressure level by a vacuum evacuating device through the vacuum evacuating pipe 12, and on the other hand, the inside of the raw material charging device 13 is vacuum evacuated to the same pressure level as that of the air-tight container 5, then the gate valve 14 is opened for charging the raw material for alloy containing active metal and additional raw material required such as scrap are additionally charged into the melting furnace 4, then such raw material within the melting furnace 4 is melted by induction heating.

At this time, as the raw material within the furnace 4 is vacuum melted by induction heating, the oxidation of alloy can be prevented. Also, when scrap is used as the raw material, a generation of slag can not be prevented at the time of melting, but an amount of slag generated can be remarkably reduced compared to that in an atmospheric melting as it is melting within the vacuum. Further, as the molten metal is maintained for a predetermined length of time with such level of power being applied that the temperature of the molten metal will not come down under the vacuum after the melting of a predetermined amount of metal is completed, the molten metal within the furnace will be settled down and the slag generated during the melting will float up to the surface of the molten metal by the difference of its specific gravity from that of the molten metal.

Next, when a pressure pouring is made by replacing the furnace cover from the vacuum melting furnace cover 9 to the pressure pouring furnace cover 25, the vacuum melting furnace cover 9 is shifted to the stand-by position by the shifting means after the air-tight container 5 is released, and the pressure pouring furnace cover 25 is shifted by the elevating and revolving device 44 from the stand-by position to the upper end of the air-tight container 5, and the pressure pouring furnace cover 25 is fixed with the bolt 28 and the retaining metal fitting 29 for tightly closing the air-tight container 5 again. Although the molten metal within the furnace will be exposed once to the atmosphere when the furnace cover is replaced to this pressure pouring furnace cover 25, a layer of the slag which has floated up to the surface of the molten metal constitutes a covering film, thus the oxidation of the molten metal in the furnace can be restrained.

When the pressure of inert gas which is controlled by the pouring pressure control device 100 is impressed to inside of the air-tight container 5 from the pressure pipe 26 of the pressure pouring furnace cover 25 and the surface of molten metal within the crucible of the melting furnace 4 is pushed down, the molten metal within the furnace ascends within the pouring siphon 32 inserted to the bottom part of the melting furnace, which is the only outlet to outside of the furnace, and is pumped up to the pouring chamber 31, and then is poured to the continuous casting equipment from the pouring nozzle 33 provided at the other end of the pouring chamber 31. While the pouring is thus made to the continuous casting equipment from the pouring nozzle 33 from the molten metal which has been pumped up from the pouring siphon 32 to the pouring chamber 31 by the pressurization, the floating slag remains floating at the surface of the molten metal within the furnace until the pouring of a prescribed amount of molten metal is completed, and will not be entrained into the pouring into the continuous casting equipment. After that, when the pressure pouring is completed, the fixing of the pressure pouring furnace cover 25 is released and the pressure pouring furnace cover 25 is made to retreat to the stand-by position and the air-tight container 5 is released.

An induction melting furnace 4 within the air-tight container 5 may be either one of a core-less crucible type induction melting furnace or of a channel type induction melting furnace, but since the core-less crucible type induction melting furnace itself has a smaller size than that of the channel type induction melting furnace, a small capacity air-tight container 5 and vacuum evacuating device may be realized and further, the entire amount of the molten metal within the furnace can be poured out as required, and a concentration of operations and the change-over of the types of metal can be made easily. When an operation with one kind of metal is done on a continuous basis, the channel type induction melting furnace is advantageous, thus it will be desirable to select the type of induction melting furnace depending on the mode of operations.

Also, an addition of raw material to be molten can be done under vacuum by using an air-tight raw material charging device 13, which is provided on the vacuum melting furnace cover 9 and can be vacuum evacuated, thus such melting amount as filling up the volume of the melting furnace can be secured. Also, a temperature control under vacuum can be done by using the molten metal temperature detecting device 33 which can be vacuum evacuated.

Further, the molten metal pumped up to the pouring chamber 31 can be poured into the continuous casting equipment without the drop in temperature of the molten metal by providing a heating device of either an external heating type or of an induction heating type at the above mentioned pouring chamber 31. Also, the vacuum melting furnace cover 9 and the pressure pouring furnace cover 25 can be shifted in the up and down direction and in the horizontal direction by cylinders or electric driving devices, thus an exchange of the furnace cover can be done in a quick and reliable manner.

As has been explained above, in an induction furnace serving both for vacuum melting and pressure pouring according to the present invention, a continuous pouring can be done without entraining generated slag, thus scrap which could not be used heretofore in a vacuum melting can now be melted as raw material, and only clean molten metal can be poured without entraining the generated slag. Further, large size ingots can be cast with a continuous casting equipment, thus the present invention has a large effect in melting and casting the alloy containing active metal with a low cost.

Although the present invention has been described and illustrated in detail, it is clearly understood that the same is by way of illustration and example only and is not to be taken by way of limitation, the spirit and scope of the invention being limited only by the terms of the appended claims.

What is claimed is:

1. An induction furnace useful both for vacuum melting and for pressure pouring, comprising an induction melting furnace housed in an air-tight container which is pressurizable to a desired maximum allowable pressure and is evacuatable to a desired level of vacuum pressure; a vacuum melting furnace cover having a vacuum evacuating pipe; and a pressure pouring furnace cover having a pressure piping to impose a pouring pressure, a control device for controlling pressure inside the furnace, and a pouring siphon having a lower end opened to a bottom part within said induction melting furnace and an upper end connected to a pouring chamber having a pouring nozzle, the pouring siphon penetrating through the pressure pouring furnace cover; whereby metal vacuum melted in the induction melting furnace with the air-tight container tightly closed with said vacuum melting furnace cover and vacuum evacuated with the vacuum evacuating pipe is pourable from the pouring nozzle using said pouring siphon by replacing said vacuum melting furnace cover with said pressuring pouring furnace cover and by imposing pressure from the pressure piping to the air-tight container, which has been tightly closed by said pressure pouring furnace cover.

2. The induction furnace according to claim 1, wherein said induction melting furnace is a core-less crucible type induction melting furnace.

3. The induction furnace according to claim 1, wherein said induction melting furnace is a channel type induction melting furnace.

4. The induction furnace according to claim 1, wherein said vacuum melting furnace cover is equipped with a raw material charging device and a molten metal temperature detecting device, which are sealed to the vacuum melting furnace cover in an air-tight manner, and the charging device is vacuum evacuatable.

5. The induction furnace according to claim 1, wherein said pouring chamber is equipped with an external heating device.

6. The induction furnace according to claim 1, wherein said pouring chamber is equipped with an induction type heating device.

7. The induction furnace according to claim 1, wherein said vacuum melting furnace cover and said pressure pouring furnace cover are shiftable in vertical and horizontal directions relative to said induction melting furnace.

8. The induction furnace according to claim 2, wherein said vacuum melting furnace cover is equipped with a raw material charging device and a molten metal temperature detecting device, which are sealed to the vacuum melting furnace cover in an air-tight manner, and the charging device is vacuum evacuatable.

9. The induction furnace according to claim 3, wherein said vacuum melting furnace cover is equipped with a raw material charging device and a molten metal temperature detecting device, which are sealed to the vacuum melting furnace cover in an air-tight manner, and the charging device is vacuum evacuatable.

10. The induction furnace according to claim 2, wherein said pouring chamber is equipped with an external heating device.

11. The induction furnace according to claim 3, wherein said pouring chamber ms equipped with an external heating device.

12. The induction furnace according to claim 4, wherein said pouring chamber ms equipped with an external heating device.

13. The induction furnace according to claim 2, wherein said pouring chamber ms equipped with an induction type heating device.

14. The induction furnace according to claim 3, wherein said pouring chamber ms equipped with an induction type heating device.

15. The induction furnace according to claim 4, wherein said pouring chamber ms equipped with an induction type heating device.

16. The induction furnace according to claim 2, wherein said vacuum melting furnace cover and said pressure pouring furnace cover are shiftable in vertical and horizontal directions relative to said induction melting furnace.

17. The induction furnace according to claim 3, wherein said vacuum melting furnace cover and said pressure pouring furnace cover are shiftable in vertical and horizontal directions relative to said induction melting furnace.

18. The induction furnace according to claim 4, wherein said vacuum melting furnace cover and said pressure pouring furnace cover are shiftable in vertical and horizontal directions relative to said induction melting furnace.

19. The induction furnace according to claim 5, wherein said vacuum melting furnace cover and said pressure pouring furnace cover are shiftable in vertical and horizontal directions relative to said induction melting furnace.

20. The induction furnace according to claim 6, wherein said vacuum melting furnace cover and said pressure pouring furnace cover are shiftable in vertical and horizontal directions relative to said induction melting furnace.

* * * * *